US008511970B2

(12) United States Patent
Tommasone et al.

(10) Patent No.: US 8,511,970 B2
(45) Date of Patent: Aug. 20, 2013

(54) PLUG ASSEMBLY

(75) Inventors: Anthony Tommasone, Charleston, SC (US); Denise C. Tommasone, legal representative, Charleston, SC (US); Nathan Wesley Ottow, Indianapolis, IN (US); Vance A. Mahan, Martinsville, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 1198 days.

(21) Appl. No.: 12/570,670

(22) Filed: Sep. 30, 2009

(65) Prior Publication Data

US 2011/0076134 A1 Mar. 31, 2011

(51) Int. Cl.
*F01D 25/00* (2006.01)

(52) U.S. Cl.
USPC ..... 415/118; 415/220; 60/803

(58) Field of Classification Search
USPC ..... 415/118, 220, 221; 60/803
See application file for complete search history.

(56) References Cited

U.S. PATENT DOCUMENTS

| | | | | |
|---|---|---|---|---|
| 2,965,286 | A | 12/1960 | Ledwith et al. | |
| 3,007,312 | A | 11/1961 | Shutts | |
| 3,362,160 | A | 1/1968 | Bourgeois | |
| 3,690,775 | A | 9/1972 | Cousins | |
| 3,917,432 | A | 11/1975 | Feuerstein et al. | |
| 3,936,217 | A | 2/1976 | Travaglini et al. | |
| 4,300,774 | A | 11/1981 | Hollis et al. | |
| 4,406,580 | A | 9/1983 | Baran, Jr. | |
| 4,815,276 | A | 3/1989 | Hansel et al. | |
| 4,825,642 | A | 5/1989 | Radtke | |
| 5,115,636 | A | 5/1992 | Zeiser | |
| 5,431,534 | A | 7/1995 | Charbonnel | |
| 5,867,976 | A | 2/1999 | Ziegler, Jr. | |
| 6,468,033 | B1 | 10/2002 | Weidlich | |
| 7,231,817 | B2 | 6/2007 | Smed et al. | |
| 7,451,639 | B2 | 11/2008 | Goldfine et al. | |
| 8,047,769 | B2 * | 11/2011 | Ballard, Jr. | 415/118 |
| 2010/0275574 | A1 * | 11/2010 | Salunkhe | 60/39.091 |

FOREIGN PATENT DOCUMENTS

| | | |
|---|---|---|
| GB | 373940 | 6/1932 |

* cited by examiner

*Primary Examiner* — Ninh H Nguyen
(74) *Attorney, Agent, or Firm* — Krieg DeVault LLP

(57) ABSTRACT

A plug assembly is disclosed herein for a borescope inspection path defined through apertures in spaced walls. The plug assembly includes a first plug operable to at least partially close a first aperture in an inner wall. The plug assembly also includes a second plug operable to at least partially close a second aperture in an outer wall. The plug assembly also includes a member extending along an axis and connecting the first and second plugs together in spaced relation to one another along the axis. The member is operable to elastically buckle.

25 Claims, 4 Drawing Sheets

PLUG ASSEMBLY

STATEMENT REGARDING FEDERALLY SPONSORED RESEARCH OR DEVELOPMENT

The U.S. Government has a paid-up license in this invention and the right in limited circumstances to require the patent owner to license others on reasonable terms as provided for by the terms of F33615-03-D-2357 awarded by the Department of Defense.

BACKGROUND OF THE INVENTION

1. Field of the Invention

The invention relates to a plug assembly for a borescope inspection path, such as can be defined through inner and outer casings of a turbine engine.

2. Description of Related Prior Art

A borescope can be used to inspect structures that are difficult to access. The components inside turbine engines are examples of such structures. These components can be positioned inside one or more casings or housings of the turbine engine. These casings define walls that are spaced from one another. It is desirable to inspect internal components with minimal disassembly of the turbine engine. Apertures can be defined in the casing walls to allow for passage of a tip of the borescope. The borescope can be extended through these apertures and relay images of the components to a remote monitor. When the inspection is complete, the borescope is removed and the apertures are plugged.

SUMMARY OF THE INVENTION

In summary, the invention is a plug assembly for a borescope inspection path defined through apertures in spaced walls. The plug assembly includes a first plug operable to at least partially close a first aperture in an inner wall. The plug assembly also includes a second plug operable to at least partially close a second aperture in an outer wall. The plug assembly also includes a member extending along an axis and connecting the first and second plugs together in spaced relation to one another along the axis. The member is operable to elastically buckle.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF EXEMPLARY EMBODIMENTS

Figure 1:
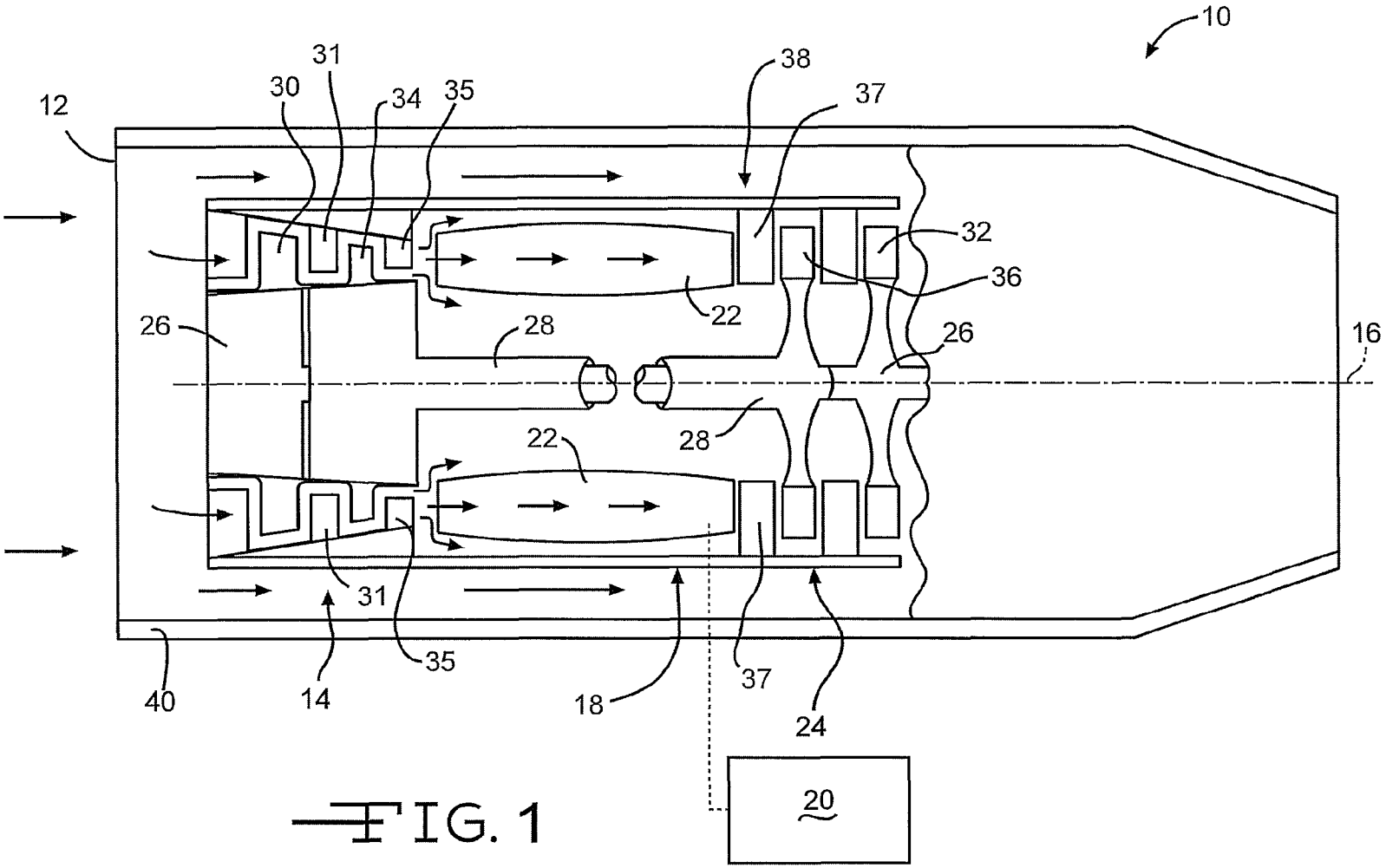
FIG. 1 is a schematic view of a turbine engine which incorporates an exemplary embodiment of the invention.

A plurality of different embodiments of the invention is shown in the Figures of the application. Similar features are shown in the various embodiments of the invention. Similar features have been numbered with a common reference numeral and have been differentiated by an alphabetic suffix. Also, to enhance consistency, the structures in any particular drawing share the same alphabetic suffix even if a particular feature is shown in less than all embodiments. Similar features are structured similarly, operate similarly, and/or have the same function unless otherwise indicated by the drawings or this specification. Furthermore, particular features of one embodiment can replace corresponding features in another embodiment or can supplement other embodiments unless otherwise indicated by the drawings or this specification.

The invention, as exemplified in the embodiments described below, can be applied to plug a borescope inspection path. The exemplary embodiments are applied in a turbine engine but the invention is not so limited. When a turbine engine operates, the various walls that define apertures for inserting a borescope can undergo thermal growth deflections and maneuver loads that affect components at different rates. Thus, the ends of a borescope plug assembly can shift laterally between two end limits of travel. Respective first end limits of travel for the ends of the borescope plug assembly can be defined when the turbine engine is not operating. This condition can correspond to substantially the lowest temperature of the turbine engine components. Respective second end limits of travel for the ends of the borescope plug assembly can be defined when the turbine engine is operating. This condition can correspond to substantially the highest temperature of the turbine engine components. It is noted that temperature is mentioned for reference purposes. Other factors beside temperature may contribute to delta movement or relative movement between the structures that receive the opposite ends of the borescope plug.

In the exemplary embodiments, the borescope plug assembly includes a first plug for at least partially closing a first aperture in a first wall and a second plug for at least partially closing a second aperture in a second wall. The first and second plugs are connected by a member such that they are spaced from one another along the axis of the member. This allows the plugs to shift relative to one another more easily. A further enhancement is to form the member such that the member can elastically buckle. The member can accommodate shifting of the positions of the first and second apertures without complex swiveling or pivoting structures. The member can be a semi-rigid, semi-flexible structure that accommodates transverse shifts relatively easily and resists axially loading relatively strongly. The exemplary borescope assemblies can operate such that some portion of the borescope assembly can deform in response to transverse loading at the ends, while the borescope assemblies are operable to withstand compressive axial loading such that the borescope plugs remain in position against forces tending to urge one or both of the plugs out of their respective receiving bores.

With modeling software it is possible to determine the extent of the relative shifting between the first and second apertures as the turbine engine components increase in temperature. In the exemplary embodiments of the borescope plug, the member connecting the plugs can be designed to buckle when the shift occurs while retaining column strength and elasticity so that the inner plug will not be moved outward by fluid pressure. Alternatively, the borescope plug can be preloaded with a buckle or bend that straightens as the temperatures of the turbine engine components increase. Thus, the embodiments allow the member interconnecting the inner and outer plugs to define a bend at some point during operation.

FIG. 1 schematically shows a turbine engine 10. The various unnumbered arrows represent the flow of fluid through the turbine engine 10. The turbine engine 10 can produce power for several different kinds of applications, including vehicle propulsion and power generation, among others. The exemplary embodiments of the invention disclosed herein, as well as other embodiments of the broader invention, can be practiced in any configuration of turbine engine and in any application other than turbine engines in which inspection of difficult to access components is desired or required.

The exemplary turbine engine 10 can include an inlet 12 to receive fluid such as air. The turbine engine 10 can include a fan to direct fluid into the inlet 12 in alternative embodiments of the invention. The turbine engine 10 can also include a compressor section 14 to receive the fluid from the inlet 12 and compress the fluid. The compressor section 14 can be spaced from the inlet 12 along a centerline axis 16 of the turbine engine 10. The turbine engine 10 can also include a combustor section 18 to receive the compressed fluid from the compressor section 14. The compressed fluid can be mixed with fuel from a fuel system 20 and ignited in an annular combustion chamber 22 defined by the combustor section 18. The turbine engine 10 can also include a turbine section 24 to receive the combustion gases from the combustor section 18. The energy associated with the combustion gases can be converted into kinetic energy (motion) in the turbine section 24.

In FIG. 1, shafts 26, 28 are shown disposed for rotation about the centerline axis 16 of the turbine engine 10. Alternative embodiments of the invention can include any number of shafts. The shafts 26, 28 can be journaled together for relative rotation. The shaft 26 can be a low pressure shaft supporting compressor blades 30 of a low pressure portion of the compressor section 14. A plurality of vanes 31 can be positioned to direct fluid downstream of the blades 30. The shaft 26 can also support low pressure turbine blades 32 of a low pressure portion of the turbine section 24.

The shaft 28 encircles the shaft 26. As set forth above, the shafts 26, 28 can be journaled together, wherein bearings are disposed between the shafts 26, 28 to permit relative rotation. The shaft 28 can be a high pressure shaft supporting compressor blades 34 of a high pressure portion of the compressor section 14. A plurality of vanes 35 can be positioned to receive fluid from the blades 34. The shaft 28 can also support high pressure turbine blades 36 of a high pressure portion of the turbine section 24. A plurality of vanes 37 can be positioned to direct combustion gases over the blades 36.

The compressor section 14 can define a multi-stage compressor, as shown schematically in FIG. 1. A "stage" of the compressor section 14 can be defined as a pair of axially adjacent blades and vanes. For example, the vanes 31 and the blades 30 can define a first stage of the compressor section 14. The vanes 35 and the blades 34 can define a second stage of the compressor section 14. The invention can be practiced with a compressor having any number of stages.

A casing 38 defines a first wall and can be positioned to surround at least some of the components of the turbine engine 10. The exemplary casing 38 can encircle the compressor section 14, the combustor section 18, and the turbine section 24. In alternative embodiments of the invention, the casing 38 may encircle less than all of the compressor section 14, the combustor section 18, and the turbine section 24. An outer casing 40 defines a second wall and is spaced radially outward of the casing 38.

Figure 2:
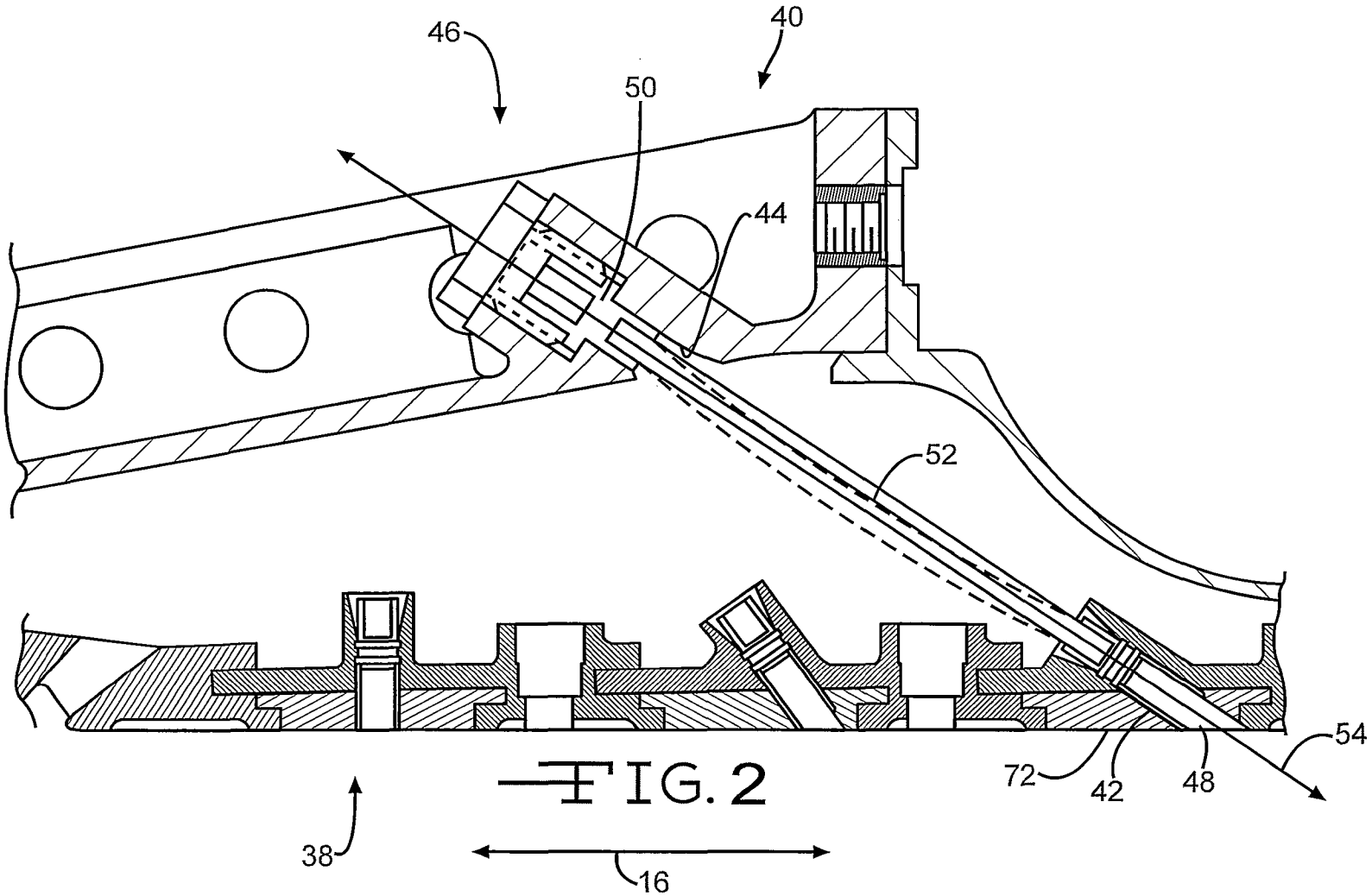
FIG. 2 is a detailed cross-sectional view of a portion of the turbine engine shown schematically in FIG. 1.

FIG. 2 is a detailed cross-section of a portion of the turbine engine 10 shown schematically in FIG. 1. The inner and outer casings 38, 40 are in radially-spaced relation to one another relative to the axis 16. A first aperture 42 is defined in the casing 38 and a second aperture 44 is defined in the casing 40. A path extending through both apertures 42, 44 is a borescope inspection path. The path is shown in FIG. 2 as a straight line. The path can be straight when the turbine engine is relatively cool, such as when the turbine engine is not operating. The path can become non-straight, such as wavy or askew, as the turbine engine operates and the temperatures of the components increase. Alternatively, the path can be non-straight initially and become straight as the temperatures of the components increase. The apertures which define portions of the borescope path can be formed in structures other than casings, such as vanes, struts, or any other component.

A first exemplary plug assembly 46 includes a first plug 48 operable to at least partially close the first aperture 42 in the casing 38. The exemplary first plug 48 can close the first aperture 42 by filling the first aperture 42. In alternative embodiments, a plug can close an aperture by covering an end of the aperture, such as with a spherical or flat surface. Also, in alternative embodiments, a plug can close an aperture by partially filling the aperture, such as shown in U.S. Pat. No. 4,406,580 wherein a plug partially fills an aperture and a seal fills the remainder of the aperture. All of these arrangements for closing an aperture can be practiced in various embodiments of the invention.

The plug assembly 46 also includes a second plug 50 operable to at least partially close the second aperture 44 in the casing 40. The second plug 50 is separately formed from the first plug 48. The exemplary plugs 48, 50 are not unitary or integral, but could be in alternative embodiments of the invention. The plugs 48, 50 can be separate when initially formed. The exemplary second plug 50 can close the second aperture 44 by filling the second aperture 44. However, in various embodiments of the invention, the second plug 44 can at least partially close the second aperture 44 as disclosed in any of the arrangements noted above.

The plug assembly 46 also includes a member 52 extending along an axis 54. The member 52 connects the first and second plugs 48, 50 together in spaced relation to one another along the axis 54. Spacing the plugs 48, 50 through a member 52 allows the member 52 to address shifting of the relative positions of the apertures 42, 44 without relying fully on complex swiveling mechanisms.

Figure 3:
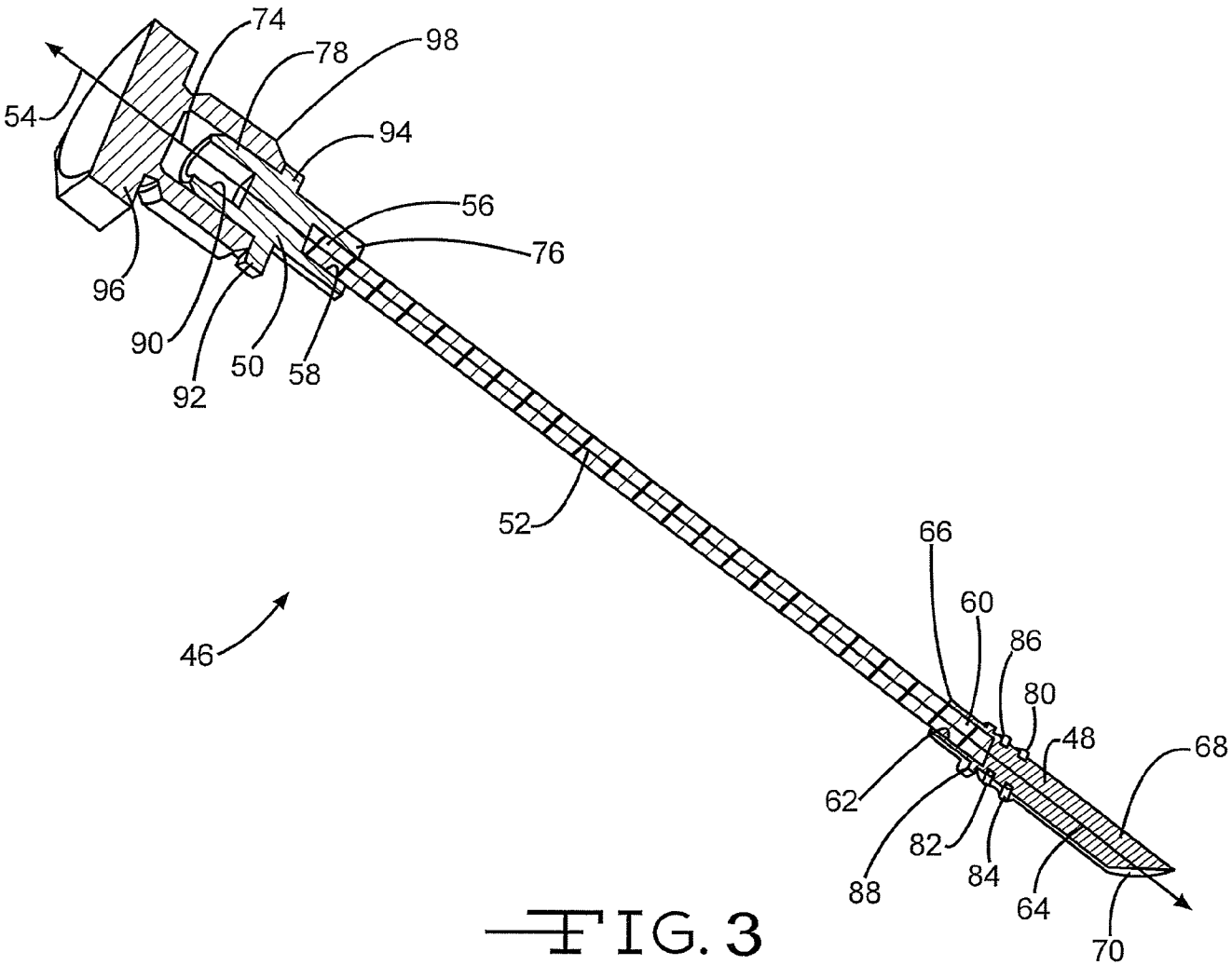
FIG. 3 is a perspective and cut-away view of a first exemplary borescope plug assembly.

The exemplary member 52 is separately formed with respect to both of the first and second plugs 48, 50. However, the member 52 can be integral with one of the plugs 48, 50. As shown in FIG. 3, a first end 56 of the exemplary member 52 can be received in a blind aperture 58 of the second plug 50. The member 52 and the second plug 50 can be brazed together. A second end 60 of the exemplary member 52 can be received in a blind aperture 62 of the first plug 48. The member 52 and the first plug 48 can be brazed together.

The axis 54 is the central axis of the member 52. The axis 54 is shown as straight in FIG. 2. FIG. 2 shows the static condition of the exemplary member 52. The static condition corresponds to the components of the turbine engine at a relatively low temperature.

In another aspect of the first exemplary embodiment, the member 52 can change shape and yet retain the capacity to substantially retain the first plug 48 in the first aperture 42. In other words, the member 52 can change shape to accommodate loading that arises from shifting of the relative positions of the apertures 42, 44. However, the appreciable deformation arising from this loading does not compromise the competency of the member 52 to generate sufficient resistance against the fluid pressure inside the casing 38. This resistance maintains the first plug 48 in the first aperture 42.

The exemplary member 52 can be operable to elastically buckle. Generally, the term "buckle" is used to refer to the behavior of straight columns under loading. As used herein, the term buckle more broadly refers to deformation of a member that is straight or non-straight when the member is not loaded. Embodiments of the invention can be practiced with members that include both straight and non-straight portions. Also, the term is used to refer to appreciable deformation distinct from microscopic deformation, such as occurring when a short column is subjected to any transverse loading that does not result in yielding or kneeling, both of which involve permanent change or plastic deformation. The member 52 can elastically buckle in that after an appreciable change in shape, the member 52 can return to original form. The member 52 can prevent the development of relatively large, stress-inducing loads in the casings 38, 40 (the structures defining the apertures 42, 44) by deforming. The member 52 is shown in a buckled condition in phantom in FIG. 2.

The elasticity and buckling capacity of the member 52 can be achieved by forming the member 52 with a high slenderness ratio. The slenderness ratio for a particular column is the effective length of the column divided by the radius of gyration of the cross-sectional area. The effective length is the actual length multiplied by some factor selected in view of how the ends of the column are held or controlled. For example, in a column having two free ends the factor is 1.2. For a column having one end clamped and the opposite end guided, the factor is also 1.2. Other factors relate to one or more of the ends being hinged. The radius of gyration is defined as:

$$r = \sqrt{\frac{I}{A}},$$

where I is the moment of inertia about the central axis of the column and A is the cross-sectional area of the column. A column having a high slenderness ratio is bound by Euler's Formula and is capable of elastic buckling. A high slenderness ratio corresponds to a relatively long column. Based on the material, a high slenderness ratio could be in the range of about 50 to about 150. A steel column having a slenderness ratio of about 150 would have high slenderness ratio. An aluminum column having a slenderness ratio of about 50 would have high slenderness ratio.

Referring now to FIGS. 2 and 3, the first plug 48 can be inserted through the aperture 44 and then the aperture 42 during assembly. The first plug 48 can extend along a first plug axis 64 between a first end 66 engaging the member 52 and a second end 68 having a profiled surface 70. The axis 64 overlaps the axis 54 in FIG. 3. The surface 70 can be aligned with the inside surface 72 of the casing 38 to enhance minimally-disturbed fluid flow in the casing 38. The surface 70 can be profiled surface in that the surface 70 is asymmetrical about the first plug axis 64 in at least one plane containing the first plug axis 64. In other words, the surface 70 can be configured for a precise orientation relative to the surface 72.

The second plug 50 can extend along a second plug axis 74 between a first end 76 engaging the member 52 and a second end 78. The axis 74 overlaps the axis 54 in FIG. 3. The second plug 50 is asymmetrical about the second plug axis 74 in at least one plane normal to the second plug axis 74. In other words, in at least one plane normal to the second plug axis 74 and positioned along the second plug axis 74 between the first and second ends 76, 78, the exemplary second plug 50 is asymmetrical such that it does not fit into the aperture 44 in an infinite number of orientations. The exemplary second plug 50 can be asymmetrical such that it fits into the aperture 44 in one orientation. The aperture 44 would be shaped similarly to the second plug 50.

In the exemplary embodiment, the second aperture 44 can be keyed to receive a key 92 defined by the second plug 50. The key 92 extends from an annular shoulder 94 of the second plug 50. The key 92 can be of any shape and project from any portion of the second plug 50. The first end 76 is insertable in the second aperture 44 and the shoulder 94, positioned further from the member 52 than the first end 76, is sized larger than the aperture 44. Thus, the second plug 50 includes structure to define a positive stop during insertion into the aperture 44.

The first plug 48 can be symmetrical about the first plug axis 64 in every plane normal to the first plug axis 64 and containing a portion of the profiled surface 70. In other words, the second end 68 of the first plug 48 can be inserted into the aperture 42 in more than one orientation. For example, the first plug 48 can be round at the second end 68. Forming the second end 68 as round and at least part of the second plug 50 to be asymmetrical allows the surface 70 to be precisely positioned by locating the second plug 50 and not the first plug 48. The second plug 50 would be proximate to the installer and easier to locate, rather the first plug 48 which would be further from the installer.

Seals 80 and 82 can be positioned in annular grooves 84, 86, respectively, defined in the first plug 48. The seals 80, 82 are associated with the first plug 48 and can seal against the aperture 42. During installation of the exemplary plug assembly 46, the first plug 48 can be inserted into the aperture 42 until the seals 80, 82 each contact the aperture 42 and a shoulder 88 abuts the casing 38. The first plug 48 thus has a thickness, defined in a direction normal to the first plug axis 64, that is variable between the first and second ends 66, 68. The shoulder 88 is an exemplary thickened portion. Other forms of variable thickness can be applied in alternative embodiments of the invention to define a positive stop for the first plug 48. Thus, the first plug 48 includes a first portion insertable in the first aperture 42 and a second portion (the shoulder 88) positioned closer to the member 52 than the first portion and sized larger than the first aperture 42.

The exemplary second plug 50 includes a blind and threaded aperture 90 at the second end 78. A tool having a threaded portion can be engaged to the aperture 90 to insert and remove the plug assembly 46.

As shown in FIG. 2, the member axis 54 can be transverse to the centerline axis 16. Alternatively, the member axis 54 can be normal to the centerline axis 16. If the member 26 is formed as non-straight, the member axis 54 can extend along an arcuate path. The member axis 54 can become non-straight during operation of the turbine engine, can become non-straight during assembly of the plug assembly 46 to the turbine engine, or can be formed as non-straight.

During assembly, the first plug 48 can be inserted into the aperture 42 until the shoulder 88 abuts the casing 38. In one embodiment, the shoulder 94 can abut the casing 40 contemporaneously with the shoulder 88 abutting the casing 38. The insertion tool can be unthreaded from the aperture 90 as the second plug 50 is rotationally fixed by engagement between the key 92 and the aperture 44. A nut 96 having threads 98 can be engaged to the casing 40 to lock the plug assembly 46 in position. In such an embodiment, the shoulder 88 is not required and can be omitted.

In another embodiment, the second plug 50 may require further movement into the aperture 44 after the shoulder 88 abuts the casing 38 so that the shoulder 94 can abut the casing 40. After the shoulder 88 abuts the casing 38, the insertion tool can be unthreaded from the aperture 90 as the second plug 50 is rotationally fixed by engagement between the key 92 and the aperture 44. The nut 96 can be threadingly engaged to the casing 40 to urge the second plug 50 further into the aperture 44 and lock the plug assembly 46 in place. The second plug 50 can be urged into the aperture 44 until the shoulder 94 abuts the casing 40. In such an embodiment, the member 52 can be subjected to compression loading between the nut 96 and the shoulder 88. The member 52 can be deformed under this loading. During operation, relative shifting between the plugs 48, 50 can result in the member 52 straightening.

As set forth above, the invention can be practiced in embodiments wherein the member connecting the first and second plugs is non-straight when not loaded. The extent that a member is non-straight can be determined based on the ease of assembly in the particular operating environment. For example, a straight member can provide the easiest assembly by allowing the plugs to be received in the apertures in the casings substantially contemporaneously. However, a non-straight member may be desirable despite some increased complexity in assembly. For example, a non-straight member can allow the plug assembly to be installed around other structures in the turbine engine. To ease assembly, the plugs can be non-straight as well.

The extent that a member is non-straight can also be determined based on the amount of force generated by the fluid in the inner casing. For example, a relatively slight bend in the member may not compromise the capacity of the member to retain the first plug in the first aperture while a relatively large bend may compromise such capacity. As set forth above, the extent of lateral shifting of the apertures 42, 44 can be determined by computer modeling. The fluid pressure in the casing 38 can also be predetermined. Thus, the member can be designed in view of this information and be non-straight. The embodiments of the invention demonstrate that non-axial, appreciable deformation can be applied in straight or non-straight members to simplify the construction of a borescope plug assembly.

Figure 4:
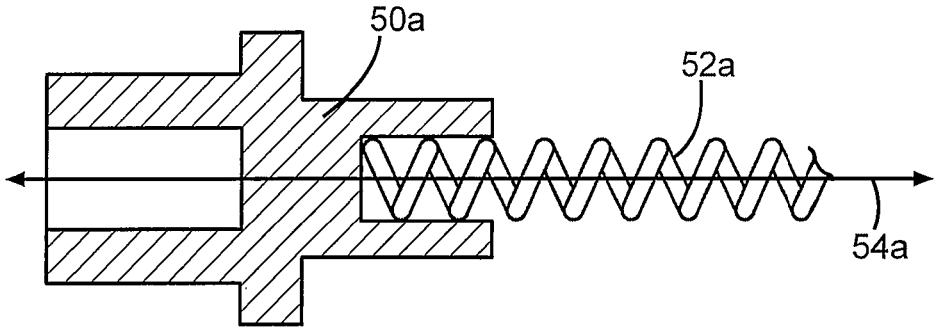
FIG. 4 is a cross-sectional view of a portion of a second exemplary embodiment of the invention.
Figure 5:
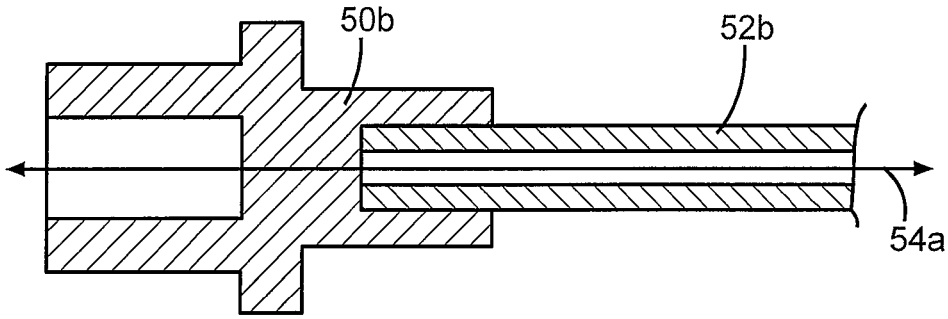
FIG. 5 is a cross-sectional view of a portion of a third exemplary embodiment of the invention.
Figure 6:
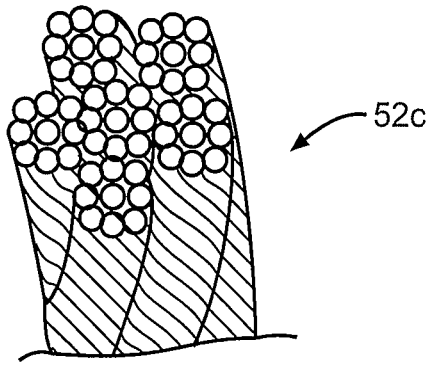
FIG. 6 is a perspective and cut-away view of a portion of a fourth exemplary embodiment of the invention.

The exemplary member 52 is shown as a solid and homogeneous structure. Alternative embodiments of the invention can be practiced with differently-configured members. As shown in FIG. 4, a member 52*a* is shown connected to a second plug 50*a* and having a helical shape along a member axis 54*a*. A member may be helical along its entire length or along only a portion of its length. As shown in FIG. 5, a member 52*b* is shown connected to a second plug 50*b* and being hollow along a member axis 54*b*. A hollow member can be formed from tubing capable of elastic deformation and capable of high temperature environments. A member may be hollow along its entire length or along only a portion of its length. FIG. 6 shows a member 52*c* formed from wire rope. The member 52*c* is thus formed from a plurality of elongate members. A wire rope includes wound elongate members, but other embodiments of the invention can be practiced with a member formed from a plurality of individual, straight elongate members.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. The right to claim elements and/or sub-combinations of the combinations disclosed herein is hereby reserved.

What is claimed is:

1. A plug assembly for a borescope inspection path defined through apertures in spaced walls and comprising:

a first plug operable to at least partially close a first aperture in an inner wall;

a second plug operable to at least partially close a second aperture in an outer wall; and a member extending along an axis and connecting said first and second plugs together in spaced relation to one another along said axis, said member operable to elastically buckle and having at least one operational configuration wherein said axis is non-straight.

2. The plug assembly of claim 1 wherein said second plug is separately formed with respect to said first plug.

3. The plug assembly of claim 1 wherein said member is separately formed with respect to both of said first and second plugs.

4. The plug assembly of claim 1 wherein said member has a high slenderness ratio.

5. The plug assembly of claim 1 wherein said member is helical along at least part of said axis.

6. The plug assembly of claim 1 wherein said member is hollow along at least part of said axis.

7. The plug assembly of claim 1 further comprising: at least one seal associated with said first plug.

8. The plug assembly of claim 1 wherein said first plug extends along a first plug axis between a first end engaging said member and a second end opposite the first end and wherein said first plug has a thickness defined in a direction normal to the first plug axis and variable between the first and second ends.

9. The plug assembly of claim 1 wherein said axis extends along an arcuate path in said at least one operational configuration of said member.

10. The plug assembly of claim 1 wherein said member is bent along said axis in said at least one operational configuration of said member.

11. The plug assembly of claim 1 wherein said member has one operational configuration wherein said axis is substantially straight and another operational configuration wherein said axis is non-straight.

12. A plug assembly for a borescope inspection path defined through apertures in spaced walls and comprising:

a first plug operable to at least partially close a first aperture in an inner wall a second plug operable to at least partially close a second aperture in an outer wall; and a member extending along an axis and connecting said first and second plugs together in spaced relation to one another along said axis, said member operable to elastically buckle, wherein said member is formed from a plurality of elongate members.

13. A plug assembly for a borescope inspection path defined through apertures in spaced walls and comprising:

a first plug operable to at least partially close a first aperture in an inner wall;

a second plug operable to at least partially close a second aperture in an outer wall; and a member extending along an axis and connecting said first and second plugs together in spaced relation to one another along said axis, said member operable to elastically buckle, wherein said member at least includes wire rope.

14. A plug assembly for a borescope inspection path defined through apertures in spaced walls and comprising:

a first plug operable to at least partially close a first aperture in an inner wall;

a second plug operable to at least partially close a second aperture in an outer wall; and a member extending along an axis and connecting said first and second plugs together in spaced relation to one another along said axis, said member operable to elastically buckle, wherein:

said first plug extends along a first plug axis between a first end engaging said member and a second end having a profiled surface, wherein said profiled surface is asymmetrical about said first plug axis in at least one plane containing said first plug axis; and said second plug extends along a second plug axis between a first end engaging said member and a second end, wherein said second plug is asymmetrical about said second plug axis in at least one plane normal to said second plug axis.

15. The plug assembly of claim 14 wherein said first plug is symmetrical about said first plug axis in every plane normal to said first plug axis and containing a portion of the profiled surface.

16. A plug assembly for a borescope inspection path defined through apertures in spaced walls and comprising:

a first plug operable to at least partially close a first aperture in an inner wall;

a second plug operable to at least partially close a second aperture in an outer wall; and a member extending along an axis and connecting said first and second plugs together in spaced relation to one another along said axis, said member operable to elastically buckle, wherein said second plug extends along a second plug axis between a first end engaging said member and a second end and wherein said second plug further comprises a blind and threaded aperture at said second end.

17. A turbine engine comprising:

a first wall extending along a centerline axis of the turbine engine and defining a first aperture;

a second wall positioned radially outward of the first wall and defining a second aperture;

a plug assembly having a first plug operable to at least partially close said first aperture in said first wall, a second plug operable to at least partially close said second aperture in said second wall, and a member extending along a member axis and connecting said first and second plugs together in spaced relation to one another along said member axis and operable to elastically buckle whereby said member has at least one operational configuration wherein said member axis is non-straight.

18. The turbine engine of claim 17 wherein said member axis is transverse to said centerline axis.

19. The turbine engine of claim 17 wherein said member and said first and second plugs are separately-formed from one another.

20. The turbine engine of claim 17 wherein said first plug includes a first portion insertable in said first aperture and a second portion positioned closer to said member than said first portion and sized larger than said first aperture.

21. The turbine engine of claim 20 wherein said second plug includes a first portion insertable in said second aperture and a second portion positioned further from said member than said first portion and sized larger than said first aperture.

22. The turbine engine of claim 17 wherein said member is bent along said member axis in said at least one operational configuration of said member.

23. The turbine engine of claim 17 wherein said member has one operational configuration wherein said member axis is substantially straight and another operational configuration wherein said member axis is non-straight.

24. A turbine engine comprising:

a first wall extending along a centerline axis of the turbine engine and defining a first aperture;

a second wall positioned radially outward of the first wall and defining a second aperture;

a plug assembly having a first plug operable to at least partially close said first aperture in said first wall, a second plug operable to at least partially close said second aperture in said second wall, and a member extending along a member axis and connecting said first and second plugs together in spaced relation to one another along said member axis and operable to elastically buckle, wherein said member axis extends along an arcuate path.

25. A turbine engine comprising:

a first wall extending along a centerline axis of the turbine engine and defining a first aperture;

a second wall positioned radially outward of the first wall and defining a second aperture;

a plug assembly having a first plug operable to at least partially close said first aperture in said first wall, a second plug operable to at least partially close said second aperture in said second wall, and a member extending along a member axis and connecting said first and second plugs together in spaced relation to one another along said member axis and operable to elastically buckle, wherein said first aperture in said first wall is round and said second aperture is keyed.

* * * * *